United States Patent [19]

Raser et al.

[11] 4,309,872

[45] Jan. 12, 1982

[54] BELLOWSLIKE THERMODYNAMIC RECIPROCATING APPARATUS

[76] Inventors: Richard A. Raser; William H. Raser, both of 6451 W. 83rd St., Los Angeles, Calif. 90045

[21] Appl. No.: 107,252

[22] Filed: Dec. 26, 1979

[51] Int. Cl.[3] ..... F02G 1/04

[52] U.S. Cl. ..... 60/517; 60/516; 60/520; 60/641.8

[58] Field of Search ..... 60/517, 527, 530, 531, 60/516, 641, 520; 92/45, 46, 89, 90

[56] References Cited

U.S. PATENT DOCUMENTS 2,963,871 12/1960 Meijer .
2,982,088 5/1961 Meijer .
3,117,414 6/1964 Daniels et al. .
4,147,414 4/1979 Ralster .

*Primary Examiner*—Allen M. Ostrager

[57] ABSTRACT

A metallic bellows consisting of two plates and one or more annular arrays of resiliently overlapping curved flexible radially-oriented strips. Each region of overlap is sealed by means of a silicone elastomer which tolerates high temperature. Overlap resilience of these strips helps accommodate greater volume displacement and long life while maintaining adequate pressure sealing. This bellows can replace the common and more expensive piston and cylinder in an engine such as a Stirling engine where it can reduce or eliminate friction and leakage losses.

10 Claims, 4 Drawing Figures

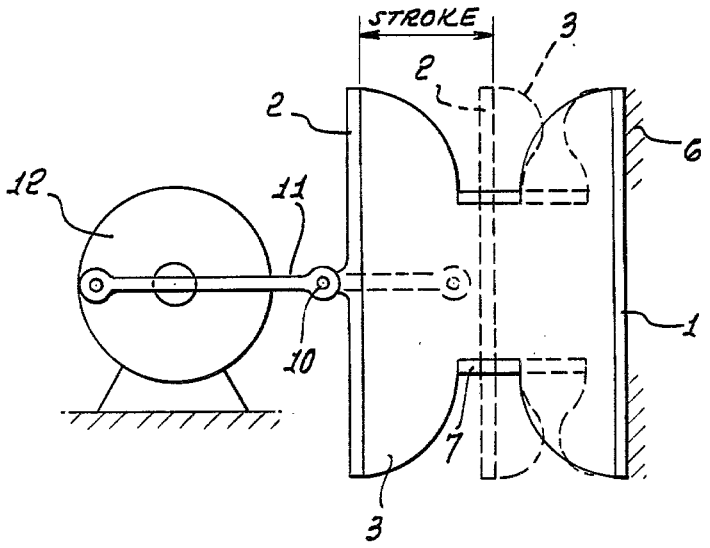
FIG. 3.
FIG. 4.
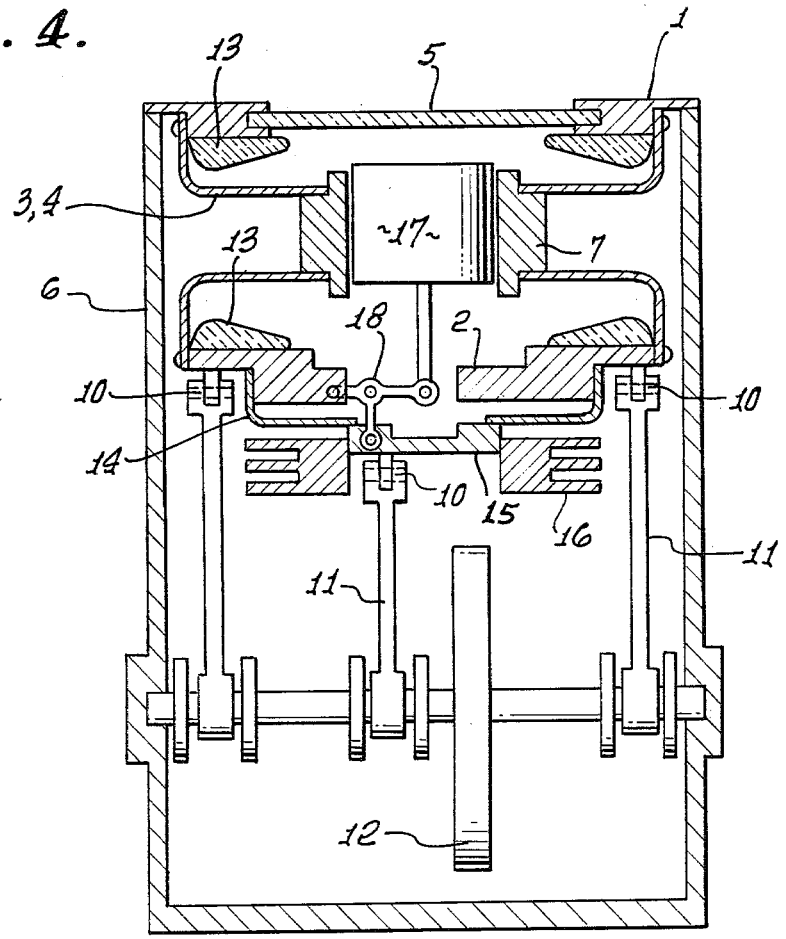

BELLOWSLIKE THERMODYNAMIC RECIPROCATING APPARATUS

BACKGROUND OF THE INVENTION

1. Field of the Invention

This invention is a bellows for conversion between thermodynamic energy and mechanical work. In an engine, this bellows can be used in place of a piston and a cylinder. One such application is the internal-focusing heat engine operating in a Stirling thermodynamic cycle so as to convert solar energy into electric power.

2. Description of the Prior Art

The most common type of metallic bellows now used is a circumferentially-pleated thin-walled expansible tube which is basically a single piece of metal. Fabricating the pleats of such a bellows usually introduces so much strain and deformation that the material must be selected more for its ductility than for its strength. Therefore, a product results which lacks stiffness and is quite limited with respect to allowable operating pressures, expansion range, temperature and reliable life.

The most efficient type of heat engine known is the type in which temperature, pressure and other thermodynamic variables theoretically follow what is called a Carnot cycle. A practical engine capable of coming close to ideal thermodynamic efficiency is the Stirling engine such as the internal focusing engine invented by Daniels and Finkelstein (U.S. Pat. No. 3,117,414). However, the achievement of high thermodynamic efficiency tends to increase the non-thermodynamic losses, particularly the friction and leakage losses.

Heretofore, some bellowslike apparatus have been used in engines to reduce friction or leakage losses. Examples are bellowslike seals by Gross and Frazier and the "roll sock seal" by Meijer. However, these examples reduce friction in only a limited and indirect way because they do not eliminate the sliding friction between a piston and a cylinder. Replacing a piston with a one-piece circumferentially-pleated bellows would introduce intolerable restrictions on pressure, volume, etc.

In its simplest form, a Stirling engine has two pistons, one to control the temperature of the working fluid which is generally a gas (usually hydrogen, air or helium) and one to transfer mechanical power (usually to extract it). Some form of coupling with piston movement is required so that cyclic thermodynamic changes (temperature, pressure, volume, etc.) in the gas can occur with desired phase relationships as in the case where the engine is a prime mover. If this coupling takes the form of a mechanical cranking mechanism such as referenced above (U.S. Pat. No. 3,117,414), the engine is called a kinematic Stirling engine. If it takes the form of tuned dynamic (elastic and inertial) forces as in the case of an engine invented by Beale, it is called a free piston Stirling engine.

SUMMARY OF THE PRESENT INVENTION

In any system for thermal conversion of solar energy to mechanical or electrical power such as the Raser system (U.S. Pat. No. 4,147,414), the least efficient step in the process is likely to be the engine. There have been a number of carefully designed Stirling engines which operate at 20% efficiency or less which clearly would operate at 30% efficiency or more if it were not for friction and leakage at the power piston (e.g., Stirling engine analysis by A. Schock, A.I.A.A. *Journal of Energy*, Vol. 2, No. 6, p. 354, 1978). Also, Stirling free piston engines can be difficult to start unless piston friction is very low. Since a looser fit between a piston and a cylinder is often needed to alleviate the friction and a tighter fit is needed to stop the leakage, there is not much a designer can do to reduce the combined power loss unless the piston can be replaced by a relatively frictionless leakage-free device. A bellows can be such a device. On a farm, if the engine drives an irrigation pump, the bellows can be used in the pump to make it more efficient also, incidentally.

The object of my present invention is to permit an implementation of the above increases in energy conversion efficiency by improving the following characteristics of a bellows: greater relative volume change or "compression ratio," longer life and higher operating pressures and temperatures than are possible with one-piece-of-metal bellows.

My invention is a bellows which is relatively free from the structural limitations and manufacturing difficulties associated with a bellows formed from a single tube or sheet. In this bellows, the flexible part includes a symmetrical array of resiliently overlapping assemblies which I call petals. With the aid of elastic sealing material at the overlapping edges, the petals together form a cavity. If there are many petaloids (petals), the cavity can resemble a bowl of which each petal resembles a sector. If the bowl is considered to consist of a cylinder and a disk, each petal is a folded sheet with a rectangle (part of the cylinder) on one side of the fold and a tapezoid (part of the disk) on the other.

Due to elastic deformation of both the petals and the sealing material, both the circle and the cylinder can be forced into approximately conical shapes. In other words, with negligible friction losses, the volume of this bowl-shaped figure can change like the volume on one side of a piston in a cylinder. Unlike the piston and cylinder, there is no leakage as long as the range of overlap distances stays within the elongation capabilities of the sealing material. To summarize by analogy, instead of a single piece of metal, my bellows consists of overlapping petals which can slide relative to each other like scales on a fish.

A model is useful in explaining the relative motion between these petals. Such a model can be constructed from a deck of playing cards. Note that two corners of each card are numbered, namely, the top left (TL) and the bottom right (BR). For n cards, let the top left corners of the first, second and last cards be designated TL1, TL2, and TLn, respectively.

The steps in constructing a cardboard model of a bowl-shaped array of petals from these cards is as follows:

(a) fold every card in half so BL falls on TL (b) open every fold halfway to produce an inside dihedral angle of 90 degrees (c) lay TL1 and BL1 on top of and one half inch to the left of TR2 and BR2, respectively and staple two cards near TL1.

(d) while holding the half inch of overlap at the fold line so it does not slip, bring corners BL2 and BL1 closer and staple BL1 to BR2; i.e., introduce a rotation equal to 360 degrees divided by n. In other words, the overlap between BL1 and BR2 will be more than one half inch.

(e) repeat steps (c) and (d), increasing all corner numbers by unity. The fold line now looks like three sides of a polygon.

(f) repeat step (e) until all cards are used (g) staple TLn and BLn to TR1 and BR1, respectively. The fold line is now a regular polygon.

The above steps yield a prismatic surface having one end partially covered. If eight cards were used, the result would be a regular octagonal prism with one end open and a small octagonal hole in the other end. If the number of cards were very large, the result would approximate a circular cylinder and can be considered to be shaped like a bowl.

With the addition of one large and one small end plate, this bowl becomes a bellows when all of the cracks and overlaps are sealed with some elastic calking material. If the distance between the two end plates is squeezed, the volume it contains will reduce. Much of this volume change occurs near the small end plate as the bottom of the bowl is deflected into a pyramidal or nearly conical shape.

Alternatives to the above bellows result from introducing the following refinements:

(a) Reduce excessive overlap by tapering one end of each card.

(b) In place of each card, substitute a three-layer stack.

(c) In place of the sharp dihedral angle, let each petal (card or stack) be given a more gradual bend, i.e., a cylindrical type curvature.

(d) To permit cancellation of a bellows twisting tendency due to the non-concurrency of perpendicular bisecting planes of elements of petal cylindrical surfaces, use two back-to-back bowl assemblies instead of a single bowl to form a bellows; in this case, two small end plates can be replaced by one interconnecting cylindrical tube.

A bellows incorporating the above four refinements is especially applicable to serve in place of a piston and cylinder in certain types of engines.

BRIEF DESCRIPTION OF THE DRAWINGS

One exemplary but not-specifically-limiting embodiment of the invention is illustrated in the four figures of the accompanying sheet of drawing in which:

FIG. 3 is a representation of FIG. 1 showing deflections imposed by a cranking mechanism.

FIG. 4 is an embodiment which extends FIG. 1 to include some of the more important parts of a Stirling engine.

DESCRIPTION OF THE PREFERRED EMBODIMENTS

Figure 2:
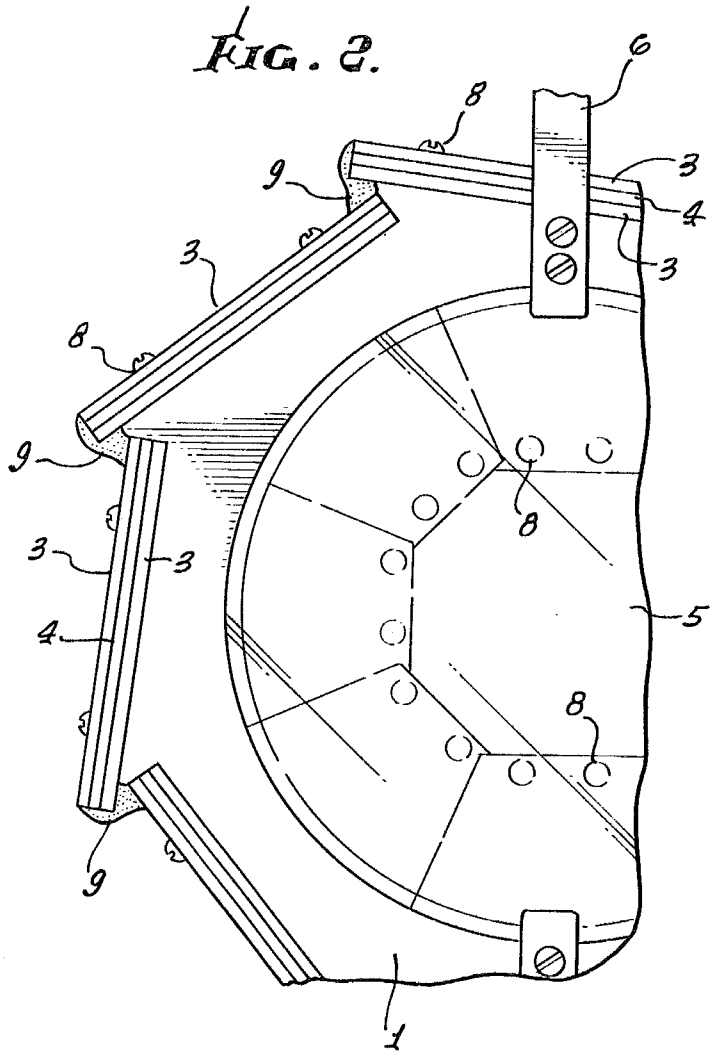
FIG. 2 is a partial end view.
Figure 1:
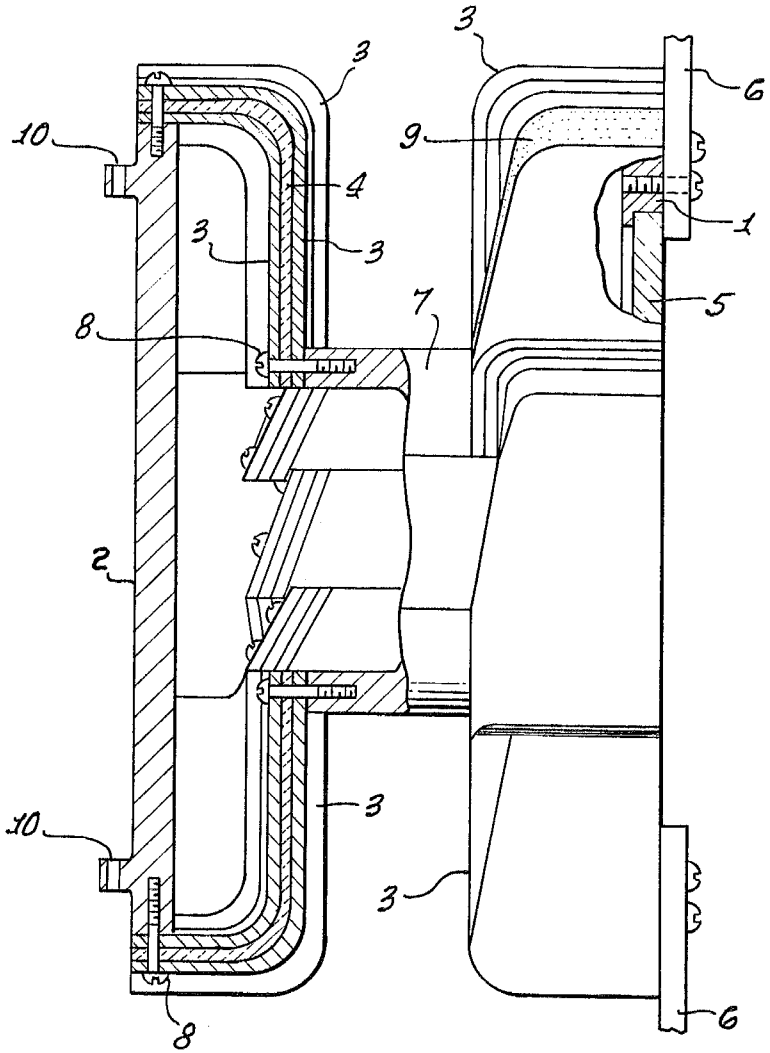
FIG. 1 is a partially cut away side view with the refinements.

A first embodiment includes a base means in the form of a plate 1, a movable plate 2, and forty eight flexed petaloidal sheets 3, 4 attached to these plates at their edges in sixteen stacks of three. Each stack is called a petal. In this embodiment, eight are attached to each plate 1, 2 although a larger number is preferred. The fixed plate is shown with a window 5 for internal focusing of radiant energy as described in U.S. Pat. No. 3,117,414. The window can be made of quartz held in place by both a flange on plate 1 and some supporting structure 6.

Each petal consists of an asbestos insulating layer 4 sandwiched between two metal sheets 3. The outboard sheet is either steel or phosphor bronze and the inboard sheet is either stainless steel or titanium. The sixteen petals form two identical eight-petal arrays called bowls which are connected by a tube 7. Attaching means between each petal, plate and the tube includes screws 8, 8.

Leakage at all cracks and joints of this bellows is prevented by a hermetic seal formed by generous use of a heat-resisting silicone elastomer 9. This sealing means is RTV-116 Silicone Rubber Compound manufactured by General Electric Company. It tolerates temperatures of 500 deg. F. indefinitely, temperatures of 600 deg. F. for limited periods and high rates of temperature change, Its elasticity up to 350% elongation and its 400 psi adhesive strength make high pressure elastic seals possible if the number of petals is large and if the material is protected from temperatures higher than these. As the number of petals per bowl exceeds eight, the wedge angle of the silicone elastomer seal 9 shown between confronting pairs of inboard and outboard petal sheets 3, 3 in FIG. 2 becomes less than the 45-degree angle shown. As this wedge angle decreases, the sealing effectiveness for the same shear stress increases and greater pressures can be tolerated.

Two types of localized impregnations are used to prevent the silicone elastomer 9 from exceeding 600° F. One is at the apex or inboard end of each wedge shown in FIG. 2 where a heavy infusion of asbestos filler is introduced before the elastomer is cured. The other is selective addition of fine aluminum filings at the outboard end of each such wedge in the vicinity of each outboard sheet 3. Since the bellows can contain hot working fluid within and since an insulating sheet 4 allows the outboard sheet of each petal to remain cooler, the insulating capability of the asbestos filler and the conducting capability of the aluminum filings together keep most of the silicone elastomer cooler than it would be without these impregnations.

To facilitate good seals, both the tube 7 and the end plates must be cut to avoid gaps. The tube, which has an octagonal prismatic surface on both the inside and the outside, meets this end requirement by using one non-perpendicular and one axial cut per side of the octaton. Likewise, the end plates 1, 2 are notched to match the slopes of the eight overlapping petals.

The combination of the movable end plate 2 and means for moving it is called a movable structure. In this embodiment, this means is a pair of lugs 10 to which cranks can be attached. The movable plate is always parallel to the fixed plate; i.e., it translates in a flatwise direction.

The main features of a second embodiment are shown in FIG. 3. This embodiment differs from the first only by including a cranking mechanism. This cranking mechanism consists of lug 10, a connecting rod 11 and a crankshaft-mounted flywheel 12. FIG. 3 shows two dead center positions of the connecting rod, one using solid lines and one using dotted lines. The distance which the movable plate 2 translates between these two positions is called the stroke. This corresponds to the stroke of a piston. Means for guiding the translation of the movable plate are not shown but are well known by those familiar with the art. FIG. 3 also shows the flexure in the petals.

A third embodiment includes the following differences: having only a single bowl for simplicity; having increased compression ratio as a result of the introduction of a ceramic annulus 13 to serve as filler material to decrease dead air (gas) space; and decreasing the heat flow from the inner sheet 3 to each petal-to-petal seal 9 by having the inner sheets narrower and thinner than the outer sheets.

FIG. 4 is an embodiment which includes the FIG. 3 embodiment and represents a Stirling engine. It includes a large two-bowl bellows 3, 7, one small single-bowl bellows 14, and a linkage 18 extending the cranking mechanism to move a displacer piston 17. The two-bowl bellows has a movable end plate 2 which has an opening in the center. A smaller bowl (bellows) 14 and smaller movable plate 15 seal this opening. Attached to this smaller movable plate is another connecting rod lug 10 and some cooling fins 16.

The tube 7 of the main bellows serves as a cylinder for a loose-fitting piston 17 which is a displacer of some of the working fluid sealed inside of both bellows. A lever 18 is connected to this displacer piston to magnify and transmit to it the relative movement between the two movable plates 2, 15. Simple harmonic motion is imparted to the lugs 10, 10 of both of these movable plates by connecting rods 11, 11 which are cranked by the flywheel 12. To reduce the peak pressure requirements at both bellows, the gas outside the two bellows is pressurized by an extension of the flywheel-supporting base means 6.

A Stirling engine is essentially a prime mover with a working fluid which not only is in contact with both a hot and a cold region but also has a volume which changes cyclically. Just before the working fluid volume expands, it is heated by a displacer piston 17 which, by its movement, displaces working fluid toward the heated region. Just before the working fluid is compressed, the opposite occurs. That sequence of events causes some thermodynamic work to be performed during each cycle so that the effective power piston (2, 14, 15) motion tends to accelerate.

FIG. 4 contains all the necessary elements for such an energy conversion if radiant energy is focused through the quartz window 5. This will cause most of the inside sheets 3 of the closer bowl and the closer end of the displacer piston 17 to become a hot region, particularly if these surfaces are black. An air cooled extension 16 of the smaller movable plate 15 is the cold region. As heat flows from the hot to the cold region in pulses controlled by the displacer piston 17, the pressure in the bellows responds to these pulses to make mechanical energy available.

A fifth embodiment resembles FIG. 4 but is without the radiant energy window and without the high temperature tolerance in the elastomer. Heat exchanger means are well known which can utilize the temperature difference between 32 degrees F., the temperature of an iceberg, and 50 degrees F., the temperature of ocean water to power the engine.

I claim:

1. In an engine, bellowslike apparatus which couples cyclic thermodynamic changes in a fluid to a reciprocating mechanical motion, comprising:

base means;

a bowl-shaped array of resiliently overlapping flexed petals;

means for attaching one end of each of the petals to a corresponding surface on the perimeter of said base means;

movable structure capable of reciprocating translation relative to said base means;

means for attaching the other end of each of the petals to said movable structure; and a resilient sealing means which forms a hermetic confinement of the volume bounded by said base means, said movable structure, said petal array and its attaching means and which permits a greater volume change and a larger reciprocating mechanical stroke than would be possible if petal overlap distances were fixed.

2. Apparatus of claim 1 in which the volume bounded by said base means, said array of petals and said movable structure is partly occupied by a ceramic annulus to reduce the dead space volume of the working fluid.

3. Apparatus of claim 1 in which the base means contains a quartz window for trapping sunlight and for heating a sealed volume of gas just as a greenhouse traps heat from sunlight.

4. Apparatus of claim 1 in which said sealing means comprises impregnated strips of heat-resisting silicone elastomer.

5. Apparatus of claim 4 in which each of said petals is a three-layered dihedral-forming sector consisting of thin insulation sandwiched between two layers of sheet metal, one end of each of these sectors lying approximately in one plane, the other end being approximately tangent to a single cylindrical surface normal to this single plane, the insulation within said petals serving to protect part of said sealing means from high temperatures within the sealed volume.

6. Apparatus of claim 5 in which said movable structure is a cylindrical tube, this apparatus further comprising:

a displacer piston fitted inside this cylindrical tube;

a second bowl-shaped array of resiliently overlapping flexed petals attached to the other end of the cylindrical tube than the one confronting the said array; and a movable plate attached to said second array in the same way said base means is attached to first said array, said plate being movable in a flatwise direction as a consequence of additional flexure in the petals of both said arrays.

7. A system according to claim 6 in which both said base means and said movable plate are plates with polygon shaped faces formed by notching regular polygons using one notch at each petal confrontation to facilitate pressure sealing and in which both ends of the cylindrical tube are like-wise notched to facilitate pressure sealing.

8. A system according to claim 6 further comprising:

a crankshaft-mounted flywheel supported by said base means; and connecting rods and linkages so that rotation of said flywheel causes both said movable plate and said displacer piston to reciprocate and function as power piston and displacer piston, respectively, in a kinematic Stirling engine.

9. A system according to claim 6 further comprising elastic means causing both said movable plate and said displacer piston to reciprocate and function as power piston and displacer piston, respectively, in a free piston Stirling engine.

10. An improved kinematic Stirling engine of the type having a hot section, a cold section, a pressurized gas, a displacer piston which changes the gas temperature by changing the gas position with respect to these sections and a cranking mechanism, wherein the improvement comprises:

a large bellows consisting of a plurality of resiliently overlapping flexed petals sealed with heat-resisting silicone elastomer to each other and to a cylindrical tube serving as a cylinder for the displacer piston;

a small bellows built into a plate which forms one end of said large bellows;

connecting rods from the cranking mechanism to produce reciprocating flatwise translations of both plates which form the ends of said small bellows; and linkage means connecting the displacer piston so that movement in opposite directions of the ends of the small bellows produces a temperature change in the gas, movement in the same direction produces a volume change, and the phase angle between the two causes the flow of heat from the hot section to the cold section to produce net mechanical power.

* * * * *